United States Patent [19]

Slaughter

[11] 4,419,130

[45] Dec. 6, 1983

[54] TITANIUM-DIBORIDE DISPERSION STRENGTHENED IRON MATERIALS

[75] Inventor: Edward R. Slaughter, Palm Beach Gardens, Fla.

[73] Assignee: United Technologies Corporation, Hartford, Conn.

[21] Appl. No.: 208,375

[22] Filed: Nov. 19, 1980

Related U.S. Application Data

[63] Continuation-in-part of Ser. No. 75,047, Sep. 12, 1979, abandoned.

[51] Int. Cl.[3] ..... C22C 38/56

[52] U.S. Cl. ..... 75/244; 75/128 F; 75/246

[58] Field of Search ..... 75/213, 226, 244, 246, 75/128 F; 29/420.5

[56] References Cited

U.S. PATENT DOCUMENTS

| | | | |
|---|---|---|---|
| 2,726,952 | 12/1955 | Morgan | 75/49 |
| 2,823,988 | 2/1958 | Grant et al. | 75/244 |
| 2,859,143 | 11/1958 | Nachman et al. | 148/2 |
| 3,026,197 | 3/1962 | Schramm et al. | 75/124 |
| 3,144,330 | 8/1964 | Storchheim | 75/226 |
| 3,147,543 | 9/1964 | Doerner et al. | 75/244 |
| 3,386,819 | 6/1968 | Cabane et al. | 75/124 |
| 3,598,567 | 8/1971 | Grant | 75/211 |
| 3,676,109 | 7/1972 | Cooper | 75/124 |
| 3,992,161 | 11/1976 | Cairns et al. | 29/182.5 |

OTHER PUBLICATIONS

"Chemical Abstracts": vol. 53, col. 21531; vol. 54, (1960), col. 19397; vol. 65, (1966), col. 16583; and vol. 66, (1967), col. 97768e.

"Splat Quenching of a Nickel-Chromium Steel Containing Boron and Titanium Additions" by J. V. Wood and R. W. K. Honeycombe, *Materials Science and Engineering,* 38 (1979), pp. 217-226.

"Iron-Aluminum Base Alloys: A Review of Their Feasibility as High Temperature Materials" by D. Hardwick and G. Wallwork, *Reviews on High Temperature Materials,* vol. 4, No. 1, (1978).

*Primary Examiner*—Earl C. Thomas

*Attorney, Agent, or Firm*—Charles E. Sohl

[57] ABSTRACT

A class of iron base materials which derive improved properties from the presence of a finely dispersed titanium diboride phase is described. The materials comprise a ferrous matrix containing a fine relatively uniform dispersion of titanium diboride particles are typically less than 0.1 micron in diameter and are present in number densities of $10^{10}$ per $mm^3$ or greater. These materials are produced by the rapid solidification of an iron alloy containing titanium and boron. Powder metallurgy techniques may be employed.

12 Claims, 6 Drawing Figures

10,000 X 10,000 X 10,000X 10,000 X 47,200 X

FIG. 6 STRESS RUPTURE STRENGTH
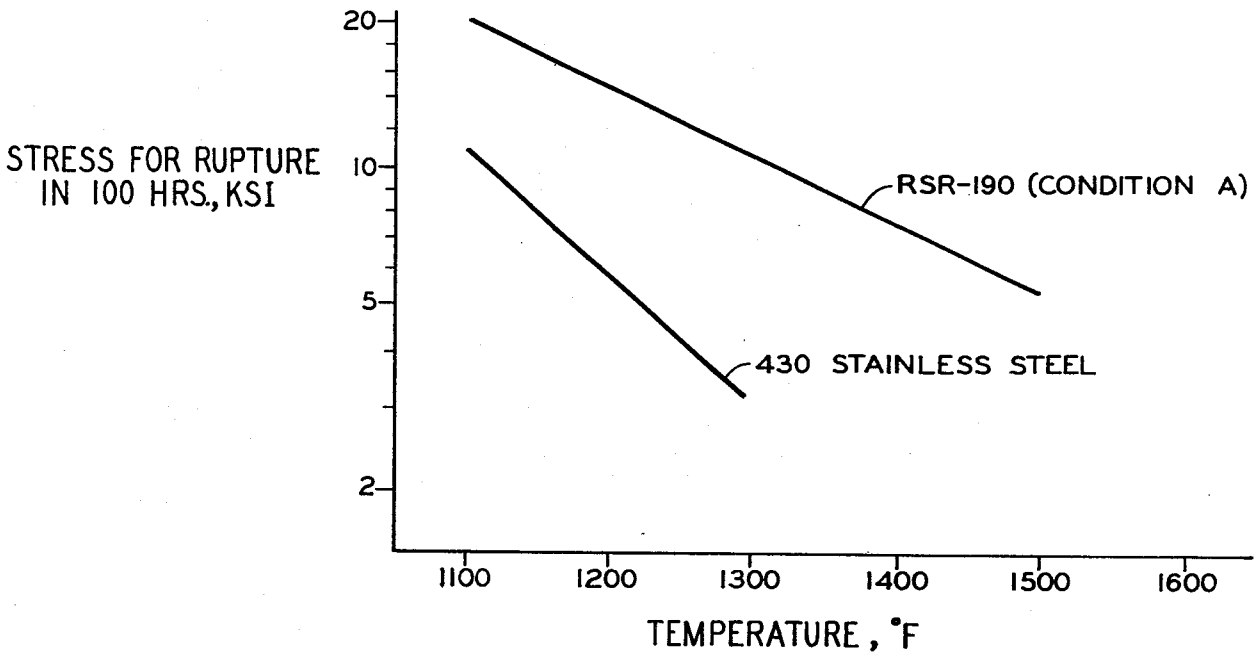

TITANIUM-DIBORIDE DISPERSION STRENGTHENED IRON MATERIALS

This application is a continuation-in-part of U.S. application Ser. No. 75,074, filed Sept. 12, 1979, now abondoned, the contents of which is incorporated herein by reference.

DESCRIPTION

1. Technical Field

This invention relates to inexpensive iron base materials containing a fine dispersion of titanium diboride particles which have a good combination of mechanical properties and oxidation resistance. The particles are developed in situ by rapid solidifications and thermomechanical processing. This invention also relates to the method for producing such dispersion strengthened iron base materials.

2. Background Art

Iron alloys probably are the most widely used class of metallic materials. There is a constant demand for iron alloys with improved properties especially alloys in which one or more properties are improved without the reduction of other properties.

Among the strengthening mechanisms which have been employed to improve properties in iron alloys is dispersion strengthening. The intent with this mechanism is to develop a uniform distribution of fine inert particles which strengthen the alloy by impeding dislocation motion and by stabilizing a fine grain size. Dispersion strengthening can improve both strength and ductility. Such dispersions are generally achieved by a powder metallurgy process in which fine inert particles are mixed with particles of the alloy to be strengthened, and the mixed particles are then compacted.

A typical patent describing this type of process is U.S. Pat. No. 3,992,161 which describes iron alloys containing a fine dispersion of refractory material such as yttria or zirconia.

In the prior art, titanium additions have been made to iron alloys for the purpose of deoxidation or precipitation hardening. This is shown, for example, in U.S. Pat. Nos. 2,859,143 and 3,676,109.

Boron has been used in iron base alloys and is known to have an effect on hardenability of some iron alloys.

Certain alloys contain both titanium and boron. Typical of these is the alloy known as Westinghouse W545 listed in the Alloy Digest as SS-87, May 1959.

U.S. Pat. No. 3,026,197 describes the addition of both zirconium and boron to iron alloys which also contain aluminum. This addition is described as providing grain refinement in these alloys which are produced by conventional casting techniques.

In the extensive patent literature on iron base alloys, almost any element may be found as an addition. The art has long sought to add aluminum to iron base for improved corrosion and oxidation resistance. Representative of patents which describe iron alloys containing aluminum are U.S. Pat. Nos. 2,726,952; 2,859,143 and 3,386,819. U.S. Pat. No. 3,144,330 describes the fabrication of iron aluminum alloys by powder metallurgy techniques.

The Russian publication "Zavodskaya Lab.", Volume 25 pages 659–661 (1959) describes an investigation of a steel which after annealing contains titanium-diboride particles. This work is mentioned in "Chemical Abstracts" Volume 53, column 21531.

U.S. Pat. No. 3,598,567 describes, in general terms, how rapid solidification can be used to reduce the particle size and spacing of (usually deleterious) phases such as sulfides. Borides are mentioned, although not titanium diboride, but the percent present, the particle size and the interparticle spacing all are substantially different than those achieved in the present invention.

Publication "WAPD-TM-80" of the U.S. Atomic Energy Commission (1957) describes fabrication by powder metallurgy of iron base alloys which include a titanium-diboride dispersion. This is referenced in "Chemical Abstracts", Volume 54 (1960) column 19397.

Russian publication "Fiz. Metal. i Metalloved", Volume 21, No. 1, pages 66–72 (1966) describe analyses of iron alloys containing titanium-diboride phase after prolonged annealing at elevated temperatures. This publication is described in "Chemical Abstracts" 65 (1966) column 16583.

Japanese publication "Nippon Kinzoku Gakkaishi", Volume 29, No. 10, pages 980–985 (1965) as described in "Chemical Abstracts", Volume 66 (1967) column 97768e indicates that boron additions to stainless steels improved corrosion resistance and that additions of titanium to stainless steels descreased corrosion resistance.

DISCLOSURE OF INVENTION

The invention described herein was made in course of or under a contract or subcontract with the Defense Advanced Research Projects Agency.

The invention concerns dispersion strengthened ferrous materials and methods for producing such materials.

The materials comprise a ferrous matrix which contains from 0.2 to 10 weight percent of titanium diboride ($TiB_2$). The $TiB_2$ particles have a typical particle size of about 0.1 micron, and are present in number densities of $10^{10}$ per $mm^3$ or greater.

The alloys are produced by rapid solidification (on the order of $10^{2°}$–$10^{4°}$ C./sec or greater) from the melt. The rapid solidification provides a dispersion of exceptionally fine $TiB_2$ particles. Subsequent to consolidation, hot working is employed to further disperse the particles.

Accordingly, it is an object of the invention to provide a new class of dispersion strengthened iron base alloys.

It is another object of the invention to describe iron base alloys, containing substantial amounts of aluminum, which are ductile as a consequence of the presence of $TiB_2$ particles.

A further object of the invention is to describe techniques for the preparation of iron base alloys which contain a dispersion of $TiB_2$ particles.

The foregoing and other objects, features and advantages of the present invention will become more apparent in light of the following detailed description of the preferred embodiments thereof as discussed and illustrated in the accompanying figures.

BRIEF DESCRIPTION OF DRAWINGS

FIG. 6 shows the stress rupture strength of an alloy processed according to the present invention contrasted with a prior art stainless steel composition.

BEST MODE FOR CARRYING OUT THE INVENTION

Figure 1:
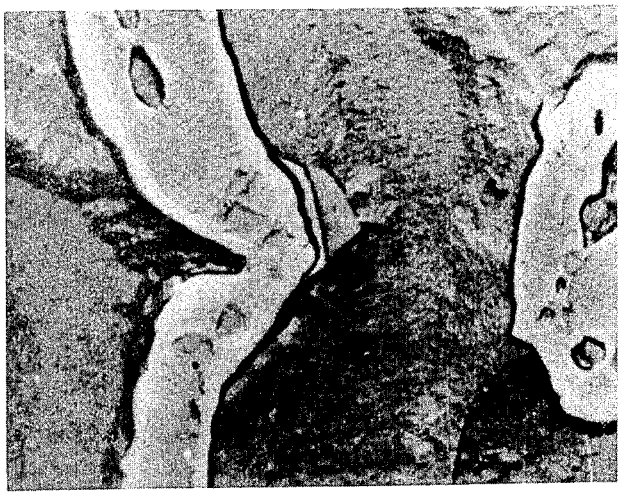
FIG. 1 shows coarse $TiB_2$ particles after slow cooling of off composition material.

The present invention relates to a novel ferrous material having exceptional mechanical properties as a consequence of a fine dispersion of in situ developed titanium diboride ($TiB_2$) particles. This invention includes both the dispersion strengthened iron material and process for producing the material.

The $TiB_2$ particles are developed in situ by a process which includes rapid solidification and hot working. The process parameters can be controlled to produce extremely fine dispersions of $TiB_2$.

The composition of the starting alloy is somewhat difficult to describe because of the wide applicability of the $TiB_2$ dispersion to iron alloys.

It is desirable that the dispersion strengthened material contain from about 0.2 to about 10 weight percent of $TiB_2$, preferably from about 0.35 to about 5% of this phase.

One preferred embodiment of the invention is the use of the fine dispersion to increase the ductility of an alloy having a matrix that would be brittle in the absence of the dispersion. In this case, the object of the invention is to provide a high number density (number of particles per $mm^3$) with as small particles as possible. This objective can be achieved with 0.2 to about 2% by weight of $TiB_2$.

Another preferred embodiment is the class of alloys in which it is desirable to have a substantial volume fraction of titanium diboride in addition to having a high number density, as for example, in an alloy having high hardness and resistance to abrasion. This objective can be achieved with higher titanium diboride contents, from about 2% to about 10% by weight. In both of these embodiments the number density of $TiB_2$ should be in excess of about $10^{10}$ per $mm^3$.

A certain relationship between titanium and boron should be maintained. The atomic ratio of titanium to boron should lie between about 0.3 and 4.0 preferably between 0.4 and 2.0 and most preferably between about 0.4 and about 0.6.

For applications in which the material must withstand elevated temperatures (i.e., greater than about 1200° F.) an excess of titanium is necessary. Excess titanium appears to substantially enhance the $TiB_2$ particles stability so that the dispersion resists coarsening. Assuming that all of titanium and boron react to form $TiB_2$, about 2.2 weight percent titanium will combine with 1 weight percent boron to form a stoichiometric quantity (3.2 weight percent) of $TiB_2$. For high temperature application the ratio of Ti to B should be calculated to be that required for stoichiometry plus an excess amount of Ti of from about 0.15 to about 1.0 weight percent. Excess titanium also appears to enhance corrosion resistance of the alloys.

The fineness of the dispersion is critical to obtaining good properties in the alloy. The best method of describing the fineness of the dispersion appears to be the number density, the number of particles per unit volumn. This is so for two reasons; first, the number density is related to the average distance between particles in a simple manner and that dimension is believed to be the fundamental factor in determining the effect of a dispersion. Second, since most of the mass of a dispersion is often concentrated in a relatively few of the largest particles in the dispersion, large statistical errors in measurement of other parameters of the dispersion can be avoided only by using very large samples, which require an unreasonable amount of effort. The number density of the $TiB_2$ particles should be $10^{10}$ per $mm^3$ or greater.

It is believed that the present invention will have equal utility if hafnium or zirconium are substituted either partially or completely for titanium on an equiatomic basis. The equivalence of zirconium and titanium has been experimentally verified and it is anticipated that hafnium diboride would be equally useful as a dispersion.

As indicated, the invention materials are iron base matrices containing dispersed $TiB_2$ particles. It is difficult, if not impossible, to adequately describe all of the other ingredients and combinations of ingredients which have been added to iron base alloys in the past.

It is believed that the present invention, which is in part the discovery of in situ developed $TiB_2$ particles as a strengthening phase, is generally applicable to virtually all of the known prior art ferrous alloys regardless of exact composition. In this application, ferrous alloys are those in which iron comprises at least 60% of the alloy by weight.

In particular, it is believed that the $TiB_2$ strengthening mechanism of the present invention is applicable to iron alloys which contain substantial amounts of other ingredients along or in combination. Table I gives a partial listing of alloying elements which have been used in prior art iron base alloys. It is believed that $TiB_2$ dispersions can strengthen iron alloys which contain these alloying elements.

TABLE I

| ELEMENT | BROAD MAX.* | PREFERRED MAX.* |
|---|---|---|
| Al | 30 | 30 |
| Cr | 20 | 15 |
| W | 20 | 10 |
| Si | 1.0 | .5 |
| Mo | 10 | 10 |
| Ni | 15 | 10 |
| Mn | 5 | 2 |
| V | 5 | 5 |
| Co | 5 | 5 |
| Cu | 5 | 1.0 |
| Cb | 5 | 5 |
| Ta | 5 | 5 |
| C | .8 | .4 |
| P | .5 | .2 |

*Weight %

Consistent with the previously presented definition given for "ferrous alloys" the sum of these alloying ingredients should not exceed 40% by weight. Additions of aluminum have been made to experimental alloys and no detrimental effects on the dispersion have been observed.

Also, a material containing 8% chromium, 1% copper, 1% molybdenum, 0.5% columbium along with 14% aluminum and 1½ weight percent of $TiB_2$ was found to have exceptional resistance to salt spray corrosion. It is believed that those skilled in the art will appreciate the general applicability of the strengthening mechanism described in the present application to a wide variety of various alloys, and that those skilled in the art can with minimum experimentation apply the present invention to a wide variety of ferrous alloys using the information in this application.

In combination with the preceding compositional ranges, certain aspects of the processing sequence are critical. The most important process limitation is that the molten alloy be solidified at a rapid rate to prevent formation of coarse $TiB_2$ particles. Cooling rates in excess of 100° F./sec are believed to be required and cooling rates in excess of 10,000° F. per sec are preferred. The most practical method known for obtaining these cooling rates is by the atomization of liquid metal by any of several processes which are well known in the powder metallurgy art.

In the experimental work described herein, the alloys were atomized using the rotary atomization technique described in U.S. Pat. Nos. 4,025,249, 4,053,264 and 4,078,873. However, the exact method does not appear important so long as a high cooling rate is achieved.

After solidification, and a minimum amount of working to compact the particles, electron microscopy reveals that the $TiB_2$ particles are present in localized areas. The particles are very fine, perhaps 100–300 Å in diameter and clustered together in the interdendritic regions. To spread these particles and distribute them more uniformly a significant amount of working is necessary. The more uniform the distribution, the better will be the mechanical properties of the alloy.

After the production of rapidly cooled material, conventional powder metallurgy type techniques can be used to provide a consolidated article. It is preferred that substantial hot working, equivalent to a true strain of at least 1.5 at a temperature between 1300° F. and 2000° F. be a part of the processing sequence. Such a hot working step appears to mix and disperse the particles throughout the matrix.

The other processing limitation is that the temperature of the material during the processing sequence not exceed about 2200° F. Above this temperature, the $TiB_2$ particles coarsen rapidly and this coarsening is not reversible. The invention will be better understood by reference to the following examples which are meant to be illustrative rather than limiting.

EXAMPLE 1

Small ingots of iron-titanium-boron alloys were prepared by non-consumale arc melting in a water cooled copper crucible in an argon atmosphere. Specimens were machined from the ingots and surface melting passes were made using a carbon dioxide laser with combinations of power density and traverse speeds to produce shallow surface melting and subsequent solidification at rates ranging roughly from $10^4$ C./sec to more than $10^6$ C./sec (see U.S. Pat. No. 4,122,240). The specimens were assembled in pairs with the welded surfaces juxtaposed in evacuated steel cans and extruded at 1600° F. at an extrusion ratio of 8:1.

The extrusions were examined by electron microscopy using replicas. The in situ $TiB_2$ particle size for each alloy was determined in the laser weld passes (rapidly solidified) and areas remote from the welds (slowly solidified). "Slowly solidified" is used in contrast with cooling rates during the laser welding solidification of roughly $10^4$ C./sec or more.

The nominal compositions of the materials are given in Table II. Materials A through G, which had Ti/B ratios of 0.22 or less, had, in the slowly solidified condition large, boride particles; some particles had dimensions in excess of 30 microns. These compositions lie outside of the present invention.

TABLE II

| Alloy | Boron Weight, percent | Atomic Ratio Titanium/Boron |
|---|---|---|
| A | 0.5 | 0.0 |
| B | 0.34 | 0.09 |
| C | 0.44 | 0.09 |
| D | 0.56 | 0.09 |
| E | 0.34 | 0.22 |
| F | 0.44 | 0.22 |
| G | 0.56 | 0.22 |
| H | 0.23 | 0.52 |
| I | 0.34 | 0.52 |
| J | 0.44 | 0.52 |
| K | 0.56 | 0.52 |
| L | 0.23 | 0.72 |
| M | 0.34 | 0.72 |
| N | 0.44 | 0.72 |
| O | 0.23 | 1.12 |

FIG. 1 shows a typical microstructure of these materials in the slowly solidified condition. In the rapidly solidified areas, the boride phase particles were smaller than in the slowly solidified regions; typical particles were about 2 microns in diameter and were spaced far apart. There were essentially no particles 0.1 micron and less in diameter.

Figure 2:
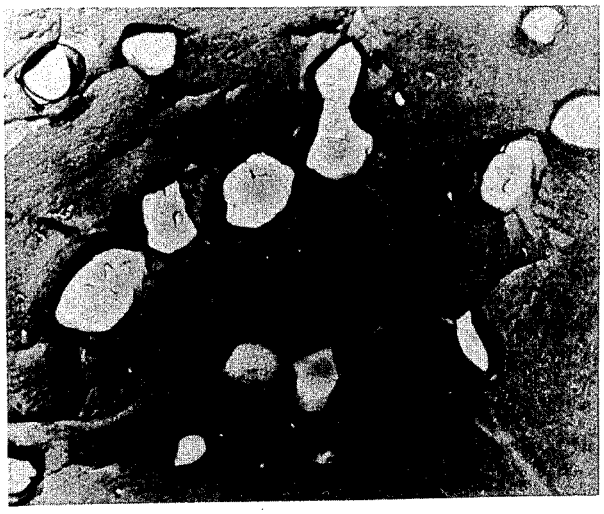
FIG. 2 shows medium $TiB_2$ particles after rapid solidification of off composition material.

FIG. 2 shows the typical microstructure of a rapidly solidified material from this group.

Figure 3:
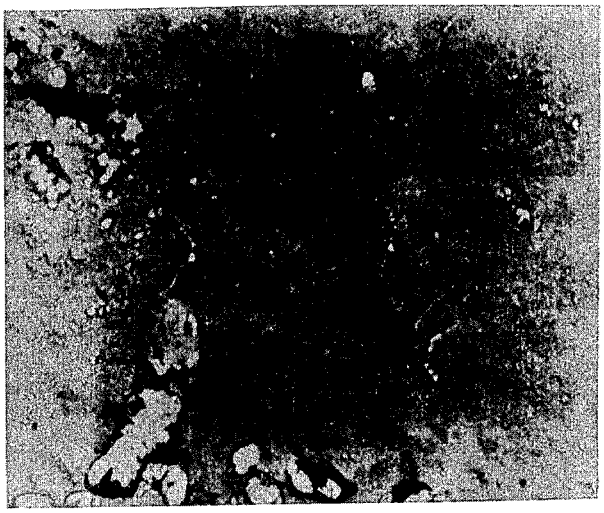
FIG. 3 shows coarse $TiB_2$ particles after slow cooling of the invention material.

Alloys H through O, which had titanium to boron ratios of 0.52 or greater, had a wide range of boride particle sizes in the slowly solidified regions. While the typical particle size appeared to be about 0.1 micron, there were a large number of particles exceeding one micron in diameter. Since the volume of a solid is proportional to the cube of its diameter, one of these larger particles had more volume than a thousand 0.1 micron particles. Most of the mass of the $TiB_2$ was present as particles one micron or larger in diameter. Therefore, the number of particles per unit volume would be less than if the borides were present as particles 0.1 micron or less in diameter in the same material. Since the effectiveness of a dispersion in improving the mechanical properties depends upon the number of particles per unit volume, these dispersions were expected to be relatively ineffective. A typical dispersion of the slowly solidified materials of this group is shown in FIG. 3.

Figure 4:
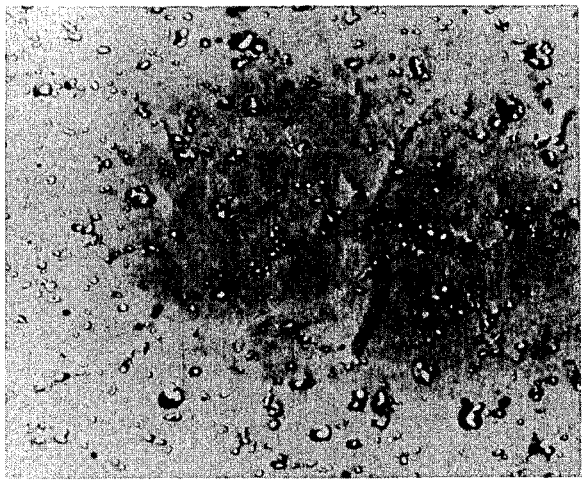
FIG. 4 shows fine $TiB_2$ particles after rapid solidification of the invention material.

The particles in rapidly solidified compositions H through O were much finer than those in the same materials which had been slowly solidified. Likewise, the number of particles per unit volume was larger. The mode of the particle size appeared to be near the limit of resolution of the metallographic technique (i.e. less than about 0.05 microns). Most of the $TiB_2$ particles were less than 0.1 micron in diameter. A typical dispersion of rapidly solidified material of this group is shown in FIG. 4.

EXAMPLE 2

In order to confirm the possibility of employing the present invention in bulk articles as opposed to the very small laboratory specimens evaluated in Example 1, a similar material was prepared as rapidly solidifed powder and processed to wrought form.

The alloy was designated as RSR 190 and contained be weight nominally 1.5% aluminum, 1.33% titanium and 0.6% boron, balance iron. This material was vacuum induction melted and processed to powder using the previously mentioned rotary atomization technique. The apparatus produced a cooling rate during solidification of about $10^5$ F./sec for −140 mesh powder. The powder was sieved to separate the −140 mesh fraction powder for consolidation. The selected powder was placed in a steel container which was evacuated and consolidated by hot isostatic pressing (HIP) at 1725° F. and a pressure of 25,000 psi for a period of three hours. The consolidated material was forged at strain rates of about 0.1/min to total true strains of 2.0 at 1400° F. using heated molybdenum alloy dies; this material will be referred to as being in Condition A.

Figure 5:
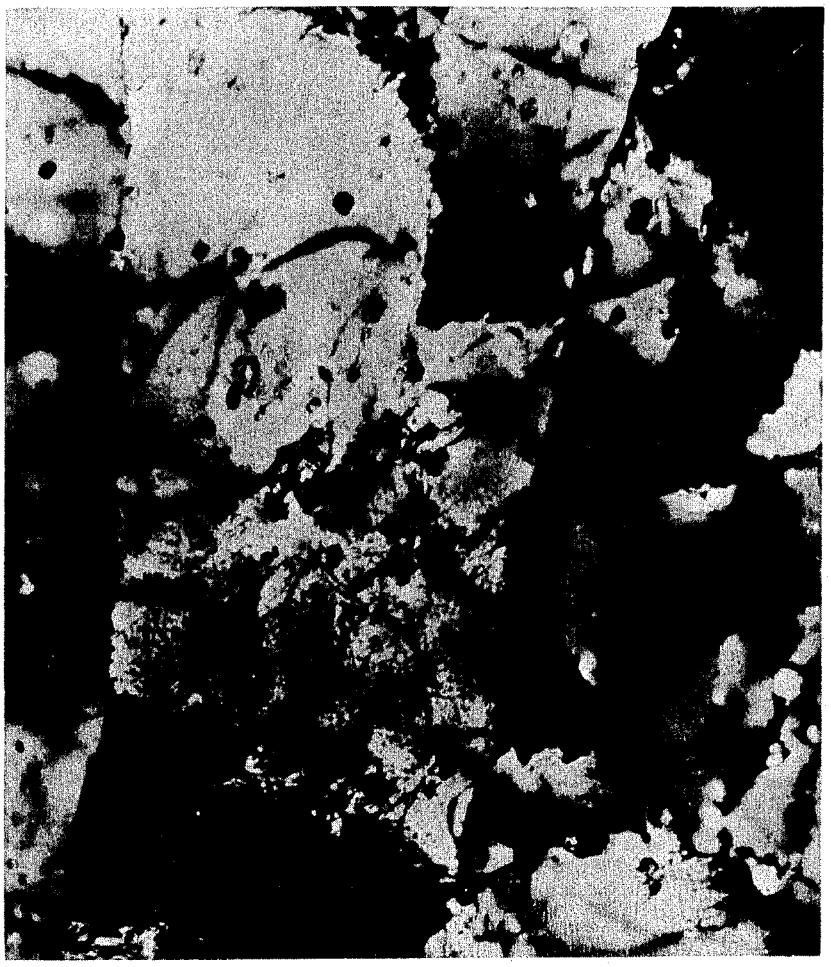
FIG. 5 shows a transmission electron micrograph of the invention material.

FIG. 5 is a thin foil transmission electron micrograph of RSR 190 in Condition A. The number density of the $TiB_2$ particles was measured to be $1.6\times10^{11}$ particles/mm$^3$ with mode of particle diameter of 0.075 microns. The particles were identified as titanium diboride.

RSR 190 material in Condition A had an exceptionally high strength at elevated temperatures for a ferritic alloy. FIG. 6 shows the stress for rupture in 100 hours for specimens tested in an argon atmosphere as a function of temperature; the strength of a typical high chromium ferritic steel, AISI 430, is also shown for comparison. The stress for rupture at 1300° F. for RSR 190 material Condition A was nearly three times as large as the corresponding strength of the AISI 430 steel. Viewed in another sense, RSR 190 material Condition A enjoyed a 275° F. temperature advantage over the ferritic chromium steel.

Since AISI 430 steel contains more effective concentrations of solid solution strengthening additions than the RSR 190 material, it appeared that the higher strength of RSR 190 material Condition A was due to fine dispersion of $TiB_2$. To test this hypothesis, specimens of RSR 190 material were annealed at 2200° F. for three hours. During this annealing treatment, the dispersion coarsened so that it no longer satisfied the criteria of the present invention for fine dispersions. Specifically, the typical particle size increased to a size in excess of 0.15 micron and particles one micron in diameter became common. The bulk of the dispersion mass was concentrated in particles nearly one micron in diameter. The number of particles per unit volume decreased by orders of magnitude. A stress rupture test of RSR 190 material with the coarsened dispersion at 1500° F. and 5000 psi stress resulted in rupture in 0.4 hours. This should be contrasted with a stress rupture life of 174 hours for the same material in Condition A.

This decrease in the time to rupture with increasing particle size confirmed that the extraordinary elevated temperature strength of RSR 190 material Condition A was due to the fineness of the dispersion.

The dispersion in RSR 190 material Condition A was seriously coarsened by annealing at 2200° F., but the dispersion was stable for extended periods at somewhat lower temperatures. Specimens examined after exposure at 1500° F. for 174 hours or 81 hours at 1600° F. still satisfied the criteria for fine dispersions; no noticeable increase in the particle size nor decrease in the number of particles per unit area (volume) was perceived in replicas.

EXAMPLE 3

A material designated as XSR-47 that contained nominally 8% aluminum, 2.04% titanium and 0.9% boron, balance iron was produced in Condition A as described in Example 2. The material in Condition A was annealed at 2275° F. to coarsen the dispersion; the dispersion coarsened to approximately the same extent as the dispersion in alloy RSR-190 annealed at 2300° F. The mechanical properties of alloy XSR-47 at room temperature were:

TABLE III

| Condition | Ultimate Tensile Strength, psi | 0.2% Offset Yield Strength, psi | Elongation % |
|---|---|---|---|
| Condition A | 125,800 | 87,800 | 23.3 |
| Annealed 2275° F. | 98,300 | 70,200 | 10.7 |

The anticipated effects were observed; the fine dispersion not only increased the strength of the alloy but also increased its ductility relative to the same alloy with a much coarser dispersion. This illustrates the importance of the fineness of the dispersion.

EXAMPLE 4

The prior art has examined iron-aluminum (cast) alloys as a function of aluminum content and found a strength maximum in the vicinity of the composition of $Fe_3Al$ (Fe-13.87 w/o Al). However, the ductility of alloys near $Fe_3Al$ in composition was very low, about 1% at room temperature. Thus, materials based in $Fe_3Al$ present a severe test of any means of improving the ductility of brittle ferrous alloys. Accordingly, a series of materials based on $Fe_3Al$ were prepared. The nominal compositions in weight percent are given in Table IV.

TABLE IV

| ALLOY | BORON | TITANIUM | ZIRCONIUM | ATOMIC RATIO Ti OR Zr/B | $Fe_3Al$ |
|---|---|---|---|---|---|
| XSR-65 | — | — | — | — | 100 |
| XSR-66 | 0.68 | 1.50 | — | 0.50 | balance |
| XSR-67 | 0.68 | 1.42 | — | 0.47 | balance |
| XSR-68 | 0.68 | — | 2.82 | 0.50 | balance |
| XSR-69 | 0.68 | 1.58 | — | 0.53 | balance |
| XSR-92 | 0.47 | 1.02 | — | 0.49 | balance |

These materials were processed into strip. The strip was annealed at 950° F. for one hour, furnace cooled to 800° F. and held at 800° F. for one hour.

The room temperature tensile properties of materials XSR-65 and XSR-66 demonstrated the benefical effect of the fine dispersion on the strength and ductility of $Fe_3Al$ based materials as shown in Table V.

TABLE V

| ALLOY | CONDITION | ULTIMATE TENSILE STRENGTH PSI | 0.2 OFFSET YIELD STRENGTH PSI | ELONGATION % |
|---|---|---|---|---|
| XSR-65 | Forged and rolled at 1700° F., annealed at 800° F. | 90,200 | 81,200 | 1 |

TABLE V-continued

| ALLOY | CONDITION | ULTIMATE TENSILE STRENGTH PSI | 0.2 OFFSET YIELD STRENGTH PSI | ELONGATION % |
|---|---|---|---|---|
| XSR-66 | Forged and rolled at 1700° F., annealed at 800° F. | 176,000 | 133,000 | 11 |
| XSR-66 | Forged and rolled at 1700° F., annealed at 2200° F. | 131,100 | 108,700 | 4 |

Alloy XSR-65 (no dispersion) was weaker and much less ductile than alloy XSR-66 with the fine dispersion (without the 2200° F. annealing treatment). The coarse dispersion in XSR-66 following the 2200° F. annealing treatment resulted in intermediate values of strength and ductility.

Alloys XSR-67, XSR-68 and XSR-69 and tensile properties that were not significantly different from those of alloy XSR-66; this indicated that the titanium to boron ratio within the range of 0.47 to 0.53 had no significant effect on mechanical properties nor did the substitution of zirconium for titanium (XSR-68). Since titanium, zirconium and hafnium are known to have similar properties and alloying effects, it would be expected that hafnium could also be substituted for titanium (on an equiatomic basis) without significant effects on tensile properties. However, since zirconium and hafnium are denser and more expensive than titanium, titanium is preferred.

The number density of alloy XSR-66 (annealed at 800° F.) was $2.6\times10''$ particles/mm$^3$ and the mode of particle size was 0.063 microns. The particles were identified as titanium diboride.

It has been shown that the mechanical properties of ferrous materials containing titanium and boron depend upon the particle size of $TiB_2$ and that rapid solidification is a necessary condition for producing the fine dispersions. It will be shown that the thermomechanical processing following rapid solidification also affects the particle size of the dispersion and the mechanical properties of the materials.

EXAMPLE 5

The origin of the $TiB_2$ dispersion in $Fe_3Al$ materials was studied using replicas made at various points during thermomechanical processing. Material XSR-92 (Example 4) was forged and rolled at 1525° F. to a total true strain of 1.1. The boride phase was concentrated in the interdendritic regions as relatively large (0.1–0.25 microns) clusters of fine (100–300 Å) particles. The particles were so close together that they were difficult to resolve.

This material was then annealed at 1675° F. for five hours and no significant effect on the boride dispersion was observed.

Alloy XSR-92 was also processed by forging and rolling at 1525° F. to a total true strain of 3.5; in this condition it had a fine dispersion of borides as a result of the breakup of the boride particle clusters.

These results indicated that the fine dispersion originated during straining at elevated temperatures as a result of mixing. Based on this work, it appears that a substantial amount of hot deformation, e.g., a true strain in excess of 1.5, is desirable to develop a truly uniform $TiB_2$ dispersion.

EXAMPLE 6

Material XSR-92 (described in Example 4) was processed by various thermomechanical processes to a total true strain of 3.5 to determine the effect of reduction per rolling pass and the rolling temperature on the tensile properties of the alloy at 1000° F. The results are shown in Table VI.

TABLE VI

| CONDITION | ULTIMATE TENSILE STRENGTH PSI | 0.2% OFFSET YIELD STRENGTH PSI | ELONGATION % |
|---|---|---|---|
| Forged and rolled at 1675° F. with strain per pass 0.29, Annealed 800° F. | 66,300 | 62,100 | 40 |
| Forged and rolled at 1675° F. with strain per pass 0.15, Annealed 800° F. | 48,100 | 42,900 | 39 |
| Forged and rolled at 1525° F. with strain per pass 0.15, Annealed 800° F. | 52,900 | 46,900 | 50 |

The heavier rolling pass schedule resulted in significantly higher strength and lowering the working temperature increased the strength moderately. Thus the preferred processing sequence involves hot work at a temperature below 1600° F., a strain per step (or pass) in excess of 0.2 and a total strain in excess of 1.5 and preferably in excess of 2.

Although this invention has been shown and described with respect to preferred embodiments thereof, it should be understood by those skilled in the art that various changes and omissions in the form and detail thereof may be made therein without departing from the spirit and scope of invention.

I claim:

1. A high strength iron base material consisting of a ferrite matrix which contains from about 0.2 to about 10 weight percent of $XB_2$ precipitate particles where X is selected from the group consisting of titanium, zirconium, and hafnium and mixtures thereof, with the particles being present in a number density of at least $10^{10}$ per mm$^3$.

2. A material as in claim 1 in which the atomic ratio of "X" to "B" is between 0.4 and 2.0.

3. A material as in claim 1 in which the atomic ratio of "X" to "B" is between 0.4 and 0.6.

4. A material as in claim 1 in which X is present in an amount between 0.15 and 1.0% in excess of that required to produce a stoichiometric amount of $XB_2$.

5. A material as in claims 1, 2, 3 or 4 in which X is Ti.

6. A material as in claim 1 which further contains up to 30 weight percent aluminum.

7. A material as in claim 1 which contains at least one element selected from the group consisting of (by weight): up to 30% aluminum; up to 20% chromium; up to 20% tungsten; up to 1.0% silicon; up to 15% nickel; up to 10% molybdenum; up to 5% manganese; up to 5% vanadium; up to 5% cobalt; up to 5% copper; up to 5% columbium; up to 5% tantalum and mixtures thereof with iron being present in an amount of at least 60%.

8. A method for producing a ferrous article having an in situ developed fine dispersion of $TiB_2$ particles consisting of:

a. providing a molten ferrous alloy containing Ti and B with the atomic ratio of Ti:B being greater than 0.4 and less than 2.0;

b. solidifying the alloy at a rate in excess of 100° C./sec using an atomization technique;

c. forming the solidified alloy into a unitary mass;

d. hot working the unitary mass.

9. A method as in claim 8 wherein the alloy contains sufficient Ti and B to provide from 0.2 to 10 weight percent of $TiB_2$ after solidification.

10. A method as in claim 8 wherein the alloy is solidified at a rate in excess of 10,000° C./sec.

11. A method as in claim 8 wherein the hot working is equivalent to or in excess of a true strain of 1.5.

12. A method as in claim 8 wherein the hot working is performed at a temperature between 1300° and 2000° F.

* * * * *

UNITED STATES PATENT AND TRADEMARK OFFICE

CERTIFICATE OF CORRECTION

PATENT NO. : 4,419,130

DATED : December 6, 1983

INVENTOR(S) : Edward R. Slaughter

It is certified that error appears in the above-identified patent and that said Letters Patent are hereby corrected as shown below:

Col. 1, line 6, "75,074" should read -- 75,047 --.

Col. 1, between lines 9 and 10, the following paragraph should be inserted:

-- The Government has rights in this invention pursuant to Contract No. F33615-77-C-5114 awarded by the Defense Advanced Research Projects Agency. --

Signed and Sealed this

*Seventeenth* Day of *April 1984*

[SEAL]

*Attest:*

GERALD J. MOSSINGHOFF

*Attesting Officer*

*Commissioner of Patents and Trademarks*